US007137175B2

(12) United States Patent
Villeneuve

(10) Patent No.: US 7,137,175 B2
(45) Date of Patent: Nov. 21, 2006

(54) CLIPBOARD WITH DUAL CLAMPING MEMBERS

(76) Inventor: Gerald Villeneuve, 23 St-Louis, Gatineau Quebec (CA) J8T 2R7

( * ) Notice: Subject to any disclaimer, the term of this patent is extended or adjusted under 35 U.S.C. 154(b) by 770 days.

(21) Appl. No.: 09/975,015

(22) Filed: Oct. 12, 2001

(65) Prior Publication Data

US 2003/0070264 A1 Apr. 17, 2003

(51) Int. Cl.
*B42F 1/02* (2006.01)

(52) U.S. Cl. ..... 24/67.5; 24/502

(58) Field of Classification Search ..... 24/67 R, 24/67.3, 67.5, 67.7, 67.11, 329, 331, 332, 24/508–511, 502; 281/45; 402/69; D19/88
See application file for complete search history.

(56) References Cited

U.S. PATENT DOCUMENTS

| | | | | | |
|---|---|---|---|---|---|
| 42,683 | A * | 5/1864 | Osborne | 24/67.7 |
| 346,839 | A * | 8/1886 | Butts | 206/451 |
| 367,274 | A * | 7/1887 | Daniels et al. | 24/67.7 |
| 457,771 | A * | 8/1891 | Clopton | 24/67.5 |
| 590,175 | A * | 9/1897 | Trussell | 24/67.7 |
| 590,273 | A * | 9/1897 | McPhee | 24/67.7 |
| 802,569 | A * | 10/1905 | Johnson | 24/67.7 |
| 1,318,598 | A * | 10/1919 | Rutherford | 24/67.1 |
| 1,766,072 | A * | 6/1930 | Hansen | 24/67.7 |
| 1,828,417 | A * | 10/1931 | Keleher | 24/67.3 |
| 6,250,249 | B1 * | 6/2001 | Yang | 24/509 |

FOREIGN PATENT DOCUMENTS

JP 2001-30672 A * 2/2001

* cited by examiner

*Primary Examiner*—James R. Brittain

(57) ABSTRACT

A clipboard comprising a pair of clamping members arranged substantially parallel one above the other and connected to each other via an intermediate connecting member having a spring loaded hinge connection at each of its elongated ends for securely clamping articles, such as paper sheets, between one of the two clamping members and a board. The lower clamping member is used to hold an existing bundle of paper sheets on the board while disengaging the upper clamping member to add extra paper sheets to said existing bundle of paper sheets. The clamping members are positioned substantially parallel to each other and the lower clamping member extends through a slot formed at the center of a back portion of the first clamping member.

7 Claims, 6 Drawing Sheets

CLIPBOARD WITH DUAL CLAMPING MEMBERS

BACKGROUND OF THE INVENTION

The present invention relates to a clipboard and more particularly to a clipboard having two clamping members spaced substantially parallel to each other for securely clamping articles, such as paper sheets, between one of the two clamping members and a board, wherein the lower clamping member is used to hold an existing bundle of paper sheets on the board while disengaging the upper clamping member to add extra paper sheets to said existing bundle of paper sheets.

There have been known in the art devices, such as clipboards, for clamping together a plurality of loose paper sheets. Since the first patented clipboard, many modifications have been proposed to improve the clamping action of the clamping member on a bundle of paper sheets placed on the board.

The most common kind of clipboard used, such as disclosed in U.S. Pat. No. 2,500,032, granted Mar. 7, 1950 to V. C. Helberg, involves a board, a supporting base fixed to said board via any suitable connecting means such as rivets, a clamping member pivotably mounted on said supporting base with the aid of a torsional spring at a pivotal axle. The clamping member is made of a metal plate which is bent into a downwardly concaving arc. The rear end of the clamping member is provided with an extension at its central portion for use as an actuating lever to pivot the clamping member between opened and closed positions to receive and grip the paper sheets.

A modification of the aforementioned U.S. Pat. No. 2,500,032 is disclosed in U.S. Pat. No. 2,783,062, granted Feb. 26, 1957 to the same applicant. It discloses a clipboard having a clip tiltably mounted on a board by means of a single unitary connecting member formed from spring sheet metal so as to provide a yieldable connection which is entirely devoid of the pivotal axle, torsional spring and other expensive features inherent in the previous structure.

Another kind of clipboard is disclosed in U.S. Pat. No. 4,989,298, granted Feb. 5, 1991 to B.-J. Wang. Disclosed is a paper clip which comprises a pressure bar to drive a clamp plate to clamp on a base plate by means of the operation of a torsional spring. The clamp plate is movably mounted to the base plate by two crank levers. The crank levers have each two conical portions at two opposite ends thereof and respectively made in an extended size so that they can be conveniently fastened in the fixing holes on the base plate and the positioning holes on the clamp plate to firmly secure the clamp plate to the base plate.

When using the known clipboards, such as those disclosed in the above references, a user must use one hand to bias the clamping member to the extent that paper sheets can be readily inserted into the interspace between the clamping member and the board while inserting new paper sheets and holding the previously clamped paper sheets with its other hand in order to prevent them from falling. Such clipboards are not useful for persons such as construction contractors, truckers and cops who work outside most of the time. They have to completely free their hands from any other articles in order to hold the previously clamped paper sheets to prevent them from falling. The same problem occurs in the case where the clipboard is removably fixed to a wall. Obviously, the only way to prevent a user from holding the previously clamped paper sheets is to hold the clipboard horizontally where there is no wind.

BRIEF SUMMARY OF THE INVENTION

The present invention is based on the object of providing a clipboard, particularly one that will solve the above problem encountered with the previous clipboards. This object is achieved in that the clipboard of the present invention comprises:

- a base plate fixedly attached to a board by bolts, nuts and washers;
- an upper clamping member having a front portion, a back portion and a tailing portion, the back portion has an opening that corresponds to the tailing portion, and said tailing portion extends substantially in a plan defined by the front portion; a free end of the back portion is spring loadably connected to the base plate at a first spring loaded hinge;
- a lower clamping member extending substantially parallel to the upper clamping member, the lower clamping member is spring loadably connected to the upper clamping member via an intermediate connecting member; said lower clamping member is connected to said intermediate connecting member at a second spring loaded hinge and said upper clamping member is connected to said intermediate connecting member at a third spring loaded hinge; the lower clamping member extends through the opening defined in the back portion of the upper clamping member; and
- an actuating lever spring loadably connected to the upper clamping member and to the intermediate connecting member at said third spring loaded hinge, the actuating lever is being used to move the lower clamping member between a raised resting position and a lowered clamping position in order to retain an existing clamped bundle of sheets on the board while said actuating lever moves the upper clamping member between a lowered clamping position and a raised actuating position in order to add an extra sheet to said existing bundle of sheets.

Further aspects, advantages and advantageous characteristics of the present invention will be apparent on reading the detailed description given hereinafter by way of example, with reference to the accompanying drawings.

DETAILED DESCRIPTION OF THE INVENTION

Figure 1:
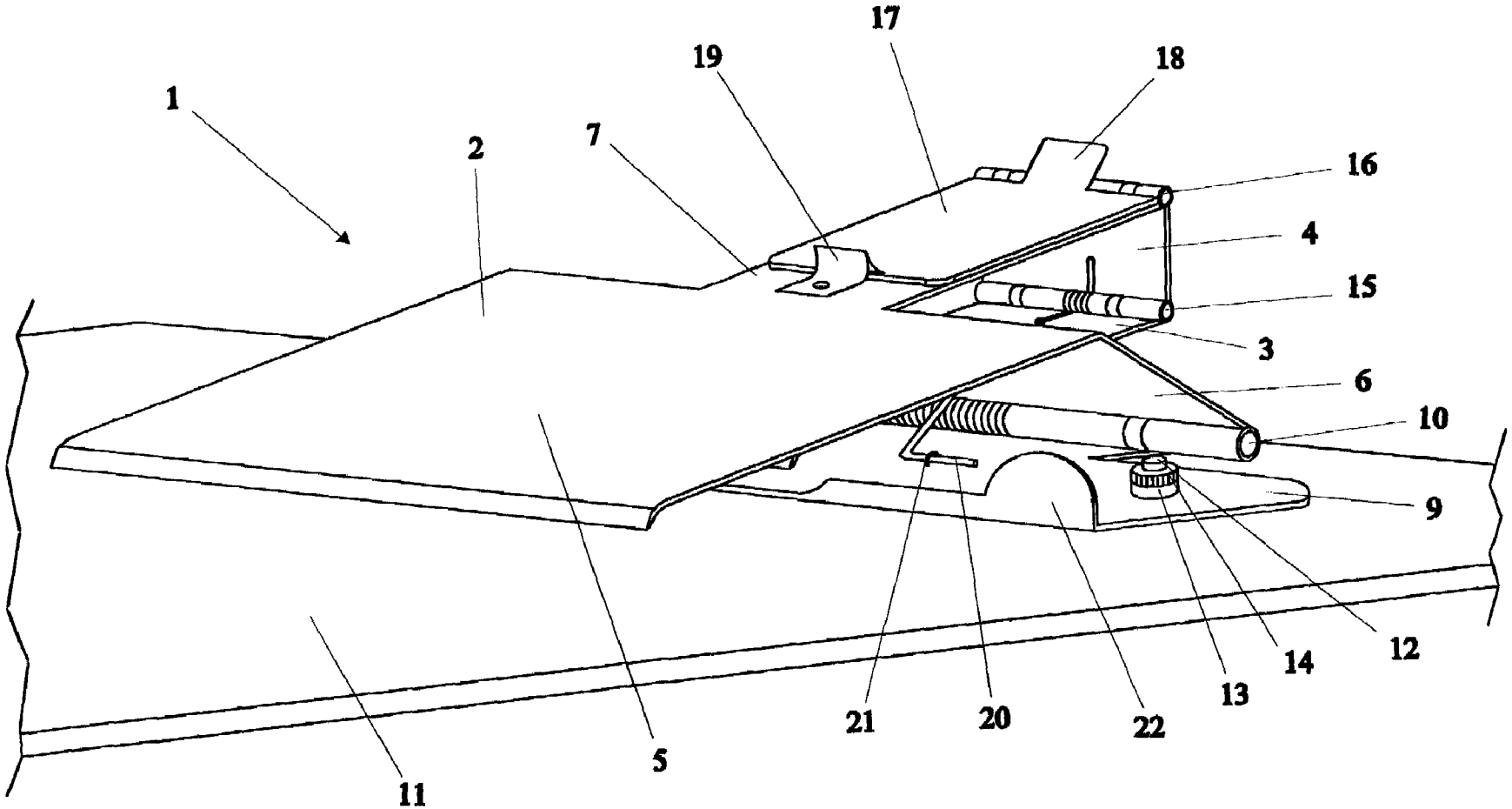
FIG. 1 is an overall perspective view of the clipboard of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one ordinary skilled in the art to which the invention relates.

Figure 2:
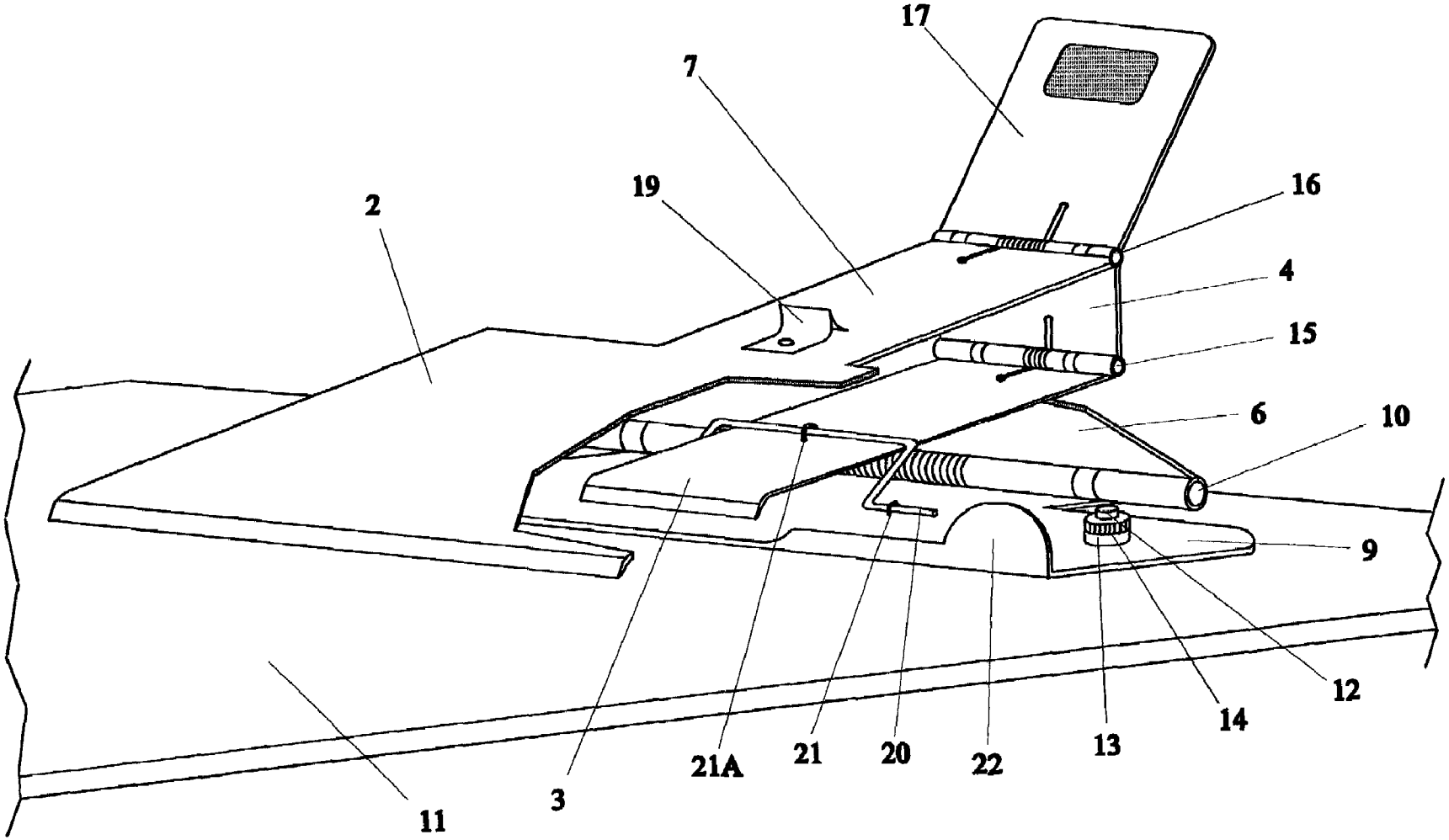
FIG. 2 is a perspective view of the clipboard of the present invention showing the lower clamping member.
Figure 3:
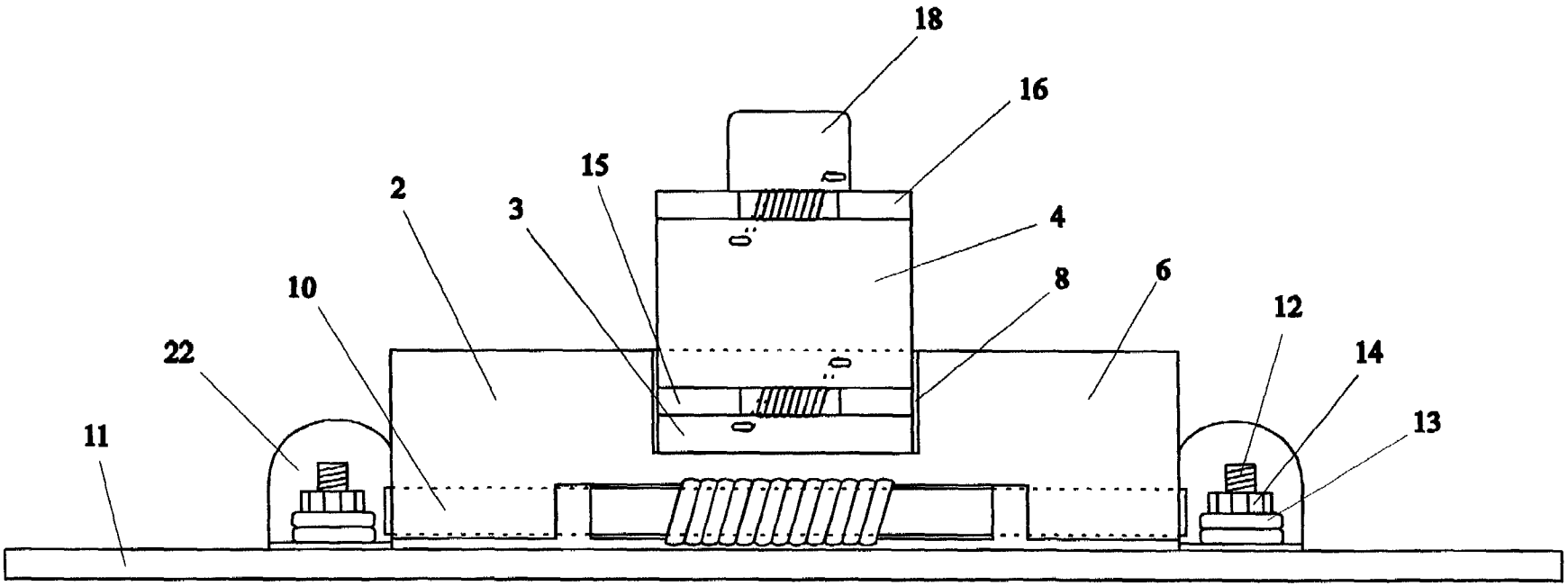
FIG. 3 is a rear view of the clipboard shown in FIG. 1.

Referring now to the drawings in detail, and particularly to FIGS. 1 and 2, a clipboard 1 according to the present invention comprises an upper clamping member 2 and a lower clamping member 3 interconnected via an intermediate connecting member 4. The upper clamping member 2 is formed by a metal plate that is bent downwardly at a folded line which divided the upper clamping member 2 into a front portion 5 and a back portion 6. A central region of the back portion 6 is cut in order to form a tailing portion 7 that is extending substantially in the same plan as the front portion 5. As shown in FIG. 3, the cut portion leaves a slot 8 for the passage of the lower clamping member 3 therethrough. The free end of the back portion 6 of the upper clamping member 2 is connected to a base plate 9 via a first spring loaded hinge 10 in order to keep a constant pressure on a board 11 at the free end of the front portion 5. The base plate 9 is removably attached to the board 11 with the aid of bolts 12, washers 13 and nuts 14. The intermediate connecting member 4 is attached at one end to the lower clamping member 3 via a second spring loaded hinge 15, and at the other end to the tailing portion 7 of the upper clamping member 2 via a third spring loaded hinge 16. An actuating lever 17 comprising a tongue portion 18 is also attached to the third spring loaded hinge 16. The actuating lever 17 is maintained in its rest position on top of the tailing portion 7 with the aid of a latch member 19 disposed on top of the upper clamping member 2 between said front portion 5 and said tailing portion 7. A cranked rod 20 is used to define a desired traveling path for the lower clamping member 3 so that the lower clamping member 3 travels between a raised position, where the lower clamping member 3 is at rest, and a lowered position, where the lower clamping member 3 is activated. The cranked rod 20 is freely secured to the base plate 9 by a pair of first eyelets 21, and to the lower clamping member 3 by one second eyelet 21A. The base plate 9 comprises a stop portion 22 that is used to prevent the bundle of sheets 23 from getting stuck under the lower clamping member 3 when the lower clamping member 3 is at its raised resting position.

Figure 4A:
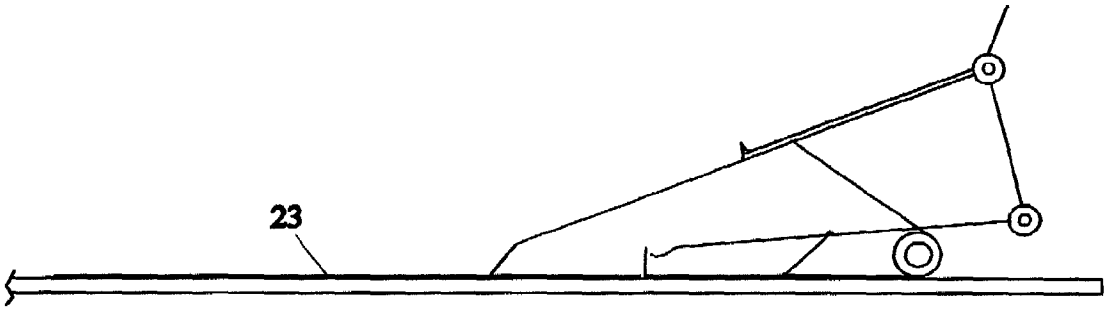
FIGS. 4A to 4F are side views of the clipboard of the present invention showing the sequential steps to be taken for adding a sheet to an already clamped bundle of sheets.
Figure 4B:
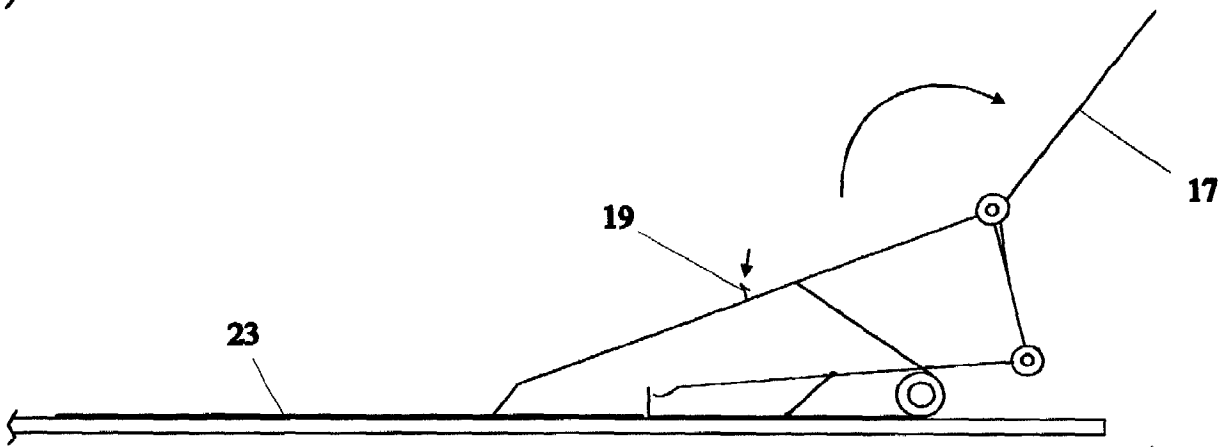
Figure 4C:
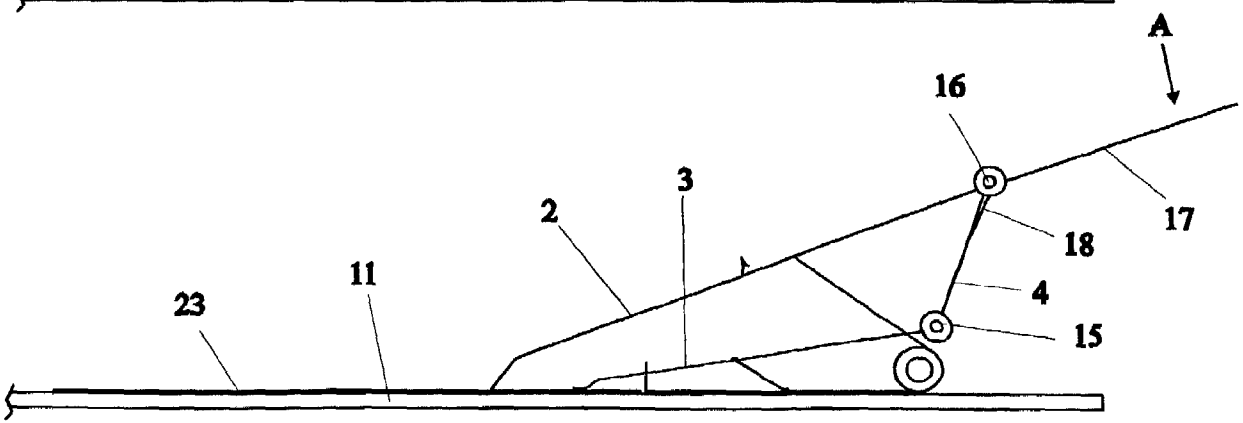

FIGS. 4A to 4F show the position of each moving member of the clipboard 1 for each sequential step took for adding a sheet to an already clamped bundle of sheets 23. FIG. 4A shows the clipboard 1 in its rest position. Starting at FIG. 4B, the first step consists in applying a pressure on the latch member 19 in order to release the springly loaded actuating lever 17. In doing so, the actuating lever 17 instantly moves to the position shown in FIG. 4B, where the tongue portion 18 comes into contact with the intermediate connecting member 4. The second step is illustrated in FIG. 4C and consists of applying a first downward force A on the actuating lever 17 until the lower clamping member 3 retains the bundle of sheets 23 on the board 11. The downward movement of the lower clamping member 3 is made possible due to the fact that the first downward force A is being transformed into a torsional force applied to the second and third spring loaded hinges 15, 16. This torsional force is created when the free end of the tongue portion 18 of the actuating lever 17 comes into contact with and applies a pressure on the back of the intermediate connecting member 4 in order to rotate said intermediate connecting member 4 about said third spring loaded hinges 16. The rotation of the intermediate connecting member 4 will then force the lower clamping member 3 to move between its raised resting position and its lowered clamping position.

Figures 4D, 4E, 4F:
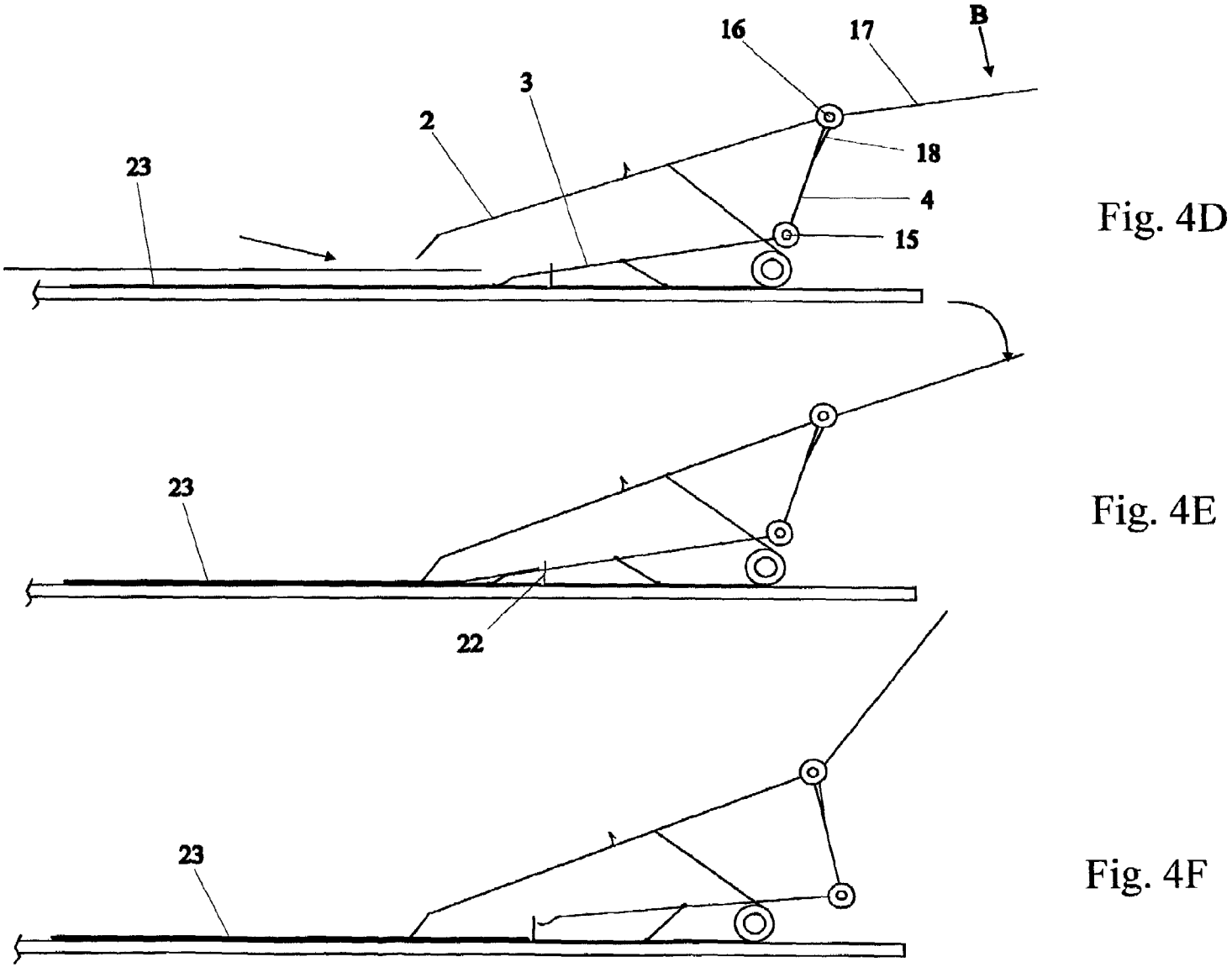

FIG. 4D illustrates the fourth step, where a second downward force B must be applied on the actuating lever 17 until the upper clamping member 2 is raised enough so that an extra sheet can be added to the clamped bundle 23. In this situation, the raising movement of the upper clamping member 2 begins only when the lower clamping member 3 has completed its downward movement in order to retain the existing bundle of sheets 23 on the board 11. The last step consists of releasing the actuating lever 17 so that the upper clamping member 2 goes back to its downward resting position and that the lower clamping member 3 goes back to its upward resting position, as shown in FIG. 4F.

Figures 5A, 5B, 5C:
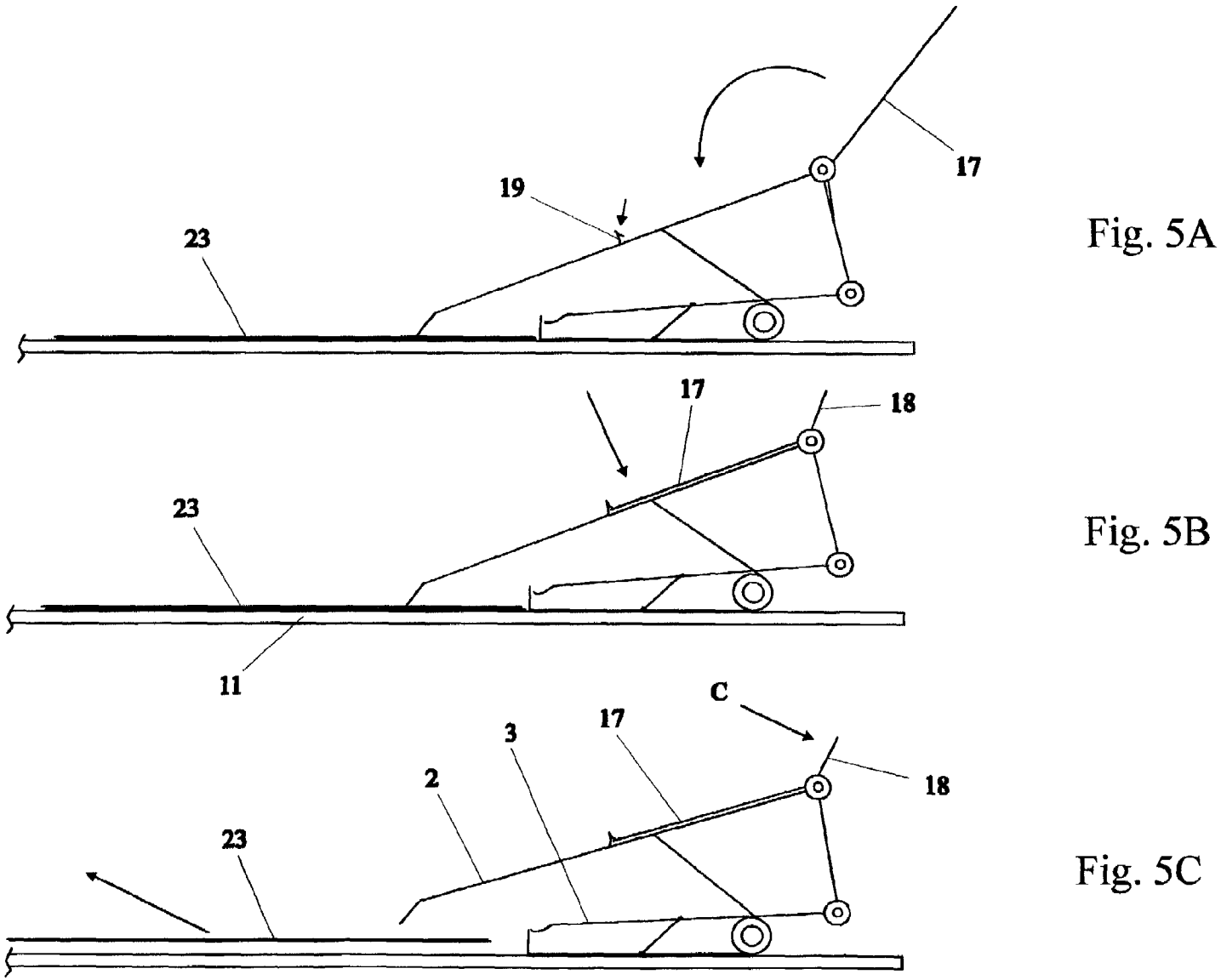
FIGS. 5A to 5C are side views of the clipboard of the present invention showing the sequential steps to be taken for removing a clamped bundle of sheets from the position of the clamping members shown in FIG. 4F.

FIGS. 5A to 5C show the sequential steps to be taken for removing a clamped bundle of sheets from the position of the clamping members shown in FIG. 4F. The first step consists of bringing the actuating lever 17 back to its clamped position, where the upper portion of the free end of the actuating lever 17 rests under the latch member 19, as shown in FIG. 5B. The second and last step is illustrated in FIG. 5C and consists of applying a third downward force C on the tongue portion 18 of the actuating lever 17 until the upper clamping member 2 is raised enough so that the bundle of sheets 23 can be removed from the clipboard 1. It is in fact possible to remove the bundle of sheets 23 from the clipboard 1 because the lower clamping member 3 stays in its raised resting position when the force C is applied on the tongue portion 18 of the actuating lever 17.

Another feature (not illustrated) of the present invention is that the clipboard 1 can be adapted to receive a large bundle of sheets 23. This feature is made possible by the use of longer bolts 12 and spacer means placed between the board 11 and the bottom of the base plate 9 in order to elevate the base plate 9 and the rest of the clamping device at a desired distance from the board 11.

The term "clipboard" used herein is employed in a generic sense such that it includes any other portable or stationary base such as a bulletin board, a display stand, an automobile or truck visor, or any suitable board, pad, or surface upon which my novel clamping device may be mounted.

While the invention has been illustrated and described in detail in the drawings and foregoing description, the same is to be considered as illustrative and not restrictive in character, it will be understood that only the preferred embodiment has been shown and described and that all changes and modifications that come within the spirit of the invention are desired to be protected. The changes and modifications that come within the spirit of the invention are also desired to be protected in view of what is defined in the appended claims.

The embodiments of the invention in which an exclusive property or privilege is claimed are defined as follows:

1. A clamping device for use in a clipboard, said clamping device comprising:

a base plate fixedly attached to a board by bolts, nuts and washers;

an upper clamping member having a front portion, a back portion and a tailing portion, said back portion having an opening corresponding to the tailing portion, and said tailing portion extending substantially in a plane defined by the front portion; a free end of the back portion being spring loadably connected to said base plate at a first spring loaded hinge;

a lower clamping member extending substantially parallel to said upper clamping member, said lower clamping member being spring loadably connected to said upper clamping member via an intermediate connecting member; said lower clamping member being connected to said intermediate connecting member at a second spring loaded hinge and said upper clamping member being connected to said intermediate connecting member at a third spring loaded hinge; said lower clamping member extending through said opening defined in the back portion of the upper clamping member; and an actuating lever spring loadably connected to said upper clamping member and to said intermediate connecting member at said third spring loaded hinge, said actuating lever being used to move said lower clamping member between a raised resting position and a lowered clamping position in order to retain an existing clamped bundle of sheets on said board while said actuating lever moves said upper clamping member between a lowered clamping position and a raised actuating position in order to add an extra sheet to said existing bundle of sheets.

2. The clamping device as defined in claim 1, wherein said upper clamping member is formed by a metal plate that is bent downwardly at a folded line which divided the upper clamping member into said front and back portions.

3. The clamping device as defined in claim 2, further comprising a latch member for retaining the actuating lever in a downwardly resting position where said actuating lever extends right on top of said tailing portion.

4. The clamping device as defined in claim 3, further comprising a cranked rod freely secured to the base plate by a first pair of eyelets and to the lower clamping member by one second eyelet, said cranked rod defining a desired traveling path for the lower clamping member such that said lower clamping member travels from its raised resting position to its lowered clamping position.

5. The clamping device as defined in claim 1, wherein said actuating lever comprises a tongue portion used to transform a downward force applied on said actuating lever into a torsional force applied to said second and third spring loaded hinges when said actuating lever is in an upwardly activated position, said torsional force being created when a free end of said tongue portion comes into contact with and applies a pressure on the intermediate connecting member in order to rotate said intermediate connecting member about said third spring loaded hinges, the rotation of the intermediate connecting member causing said lower clamping member to move between its raised resting position and its lowered clamping position.

6. The clamping device as defined in claim 5, wherein the tongue portion of said actuating lever is used to move only the upper clamping member when said actuating lever is in its downwardly resting position, said lower clamping member staying in its raised resting position during the movement made by said upper clamping member.

7. The clamping device as defined in claim 1, wherein said base plate comprises a stop portion that is used to prevent the existing clamped bundle of sheets from getting stuck under the lower clamping member when said lower clamping member is at its raised resting position.

* * * * *